US006463759B1

(12) United States Patent
Garcia et al.

(10) Patent No.: US 6,463,759 B1
(45) Date of Patent: Oct. 15, 2002

(54) JEWELRY FINDING FOR PRODUCING A NECKLACE HAVING A TWISTED APPEARANCE

(75) Inventors: Maria H. Garcia, Attleboro, MA (US); Ronald E. Precourt, Jr., Woonsocket, RI (US)

(73) Assignee: Leach & Garner Company, North Attleboro, MA (US)

( * ) Notice: Subject to any disclaimer, the term of this patent is extended or adjusted under 35 U.S.C. 154(b) by 156 days.

(21) Appl. No.: 09/636,256

(22) Filed: Aug. 10, 2000

(51) Int. Cl.[7] ..... A44C 25/00
(52) U.S. Cl. ..... 63/38; 63/3; 63/26; 63/36
(58) Field of Search ..... 63/3, 4, 26, 28, 63/36, 38

(56) References Cited

U.S. PATENT DOCUMENTS 1,197,322 A * 9/1916 Wolf ..... 63/3
1,927,038 A * 9/1933 Kane ..... 428/28
2,094,529 A * 9/1937 Fisher ..... 428/67
2,231,485 A * 2/1941 Straight et al. ..... 63/3
4,625,508 A * 12/1986 Fontana ..... 59/80
5,386,710 A * 2/1995 Moore ..... 63/3
6,241,572 B1 * 6/2001 Braginsky ..... 446/85
6,264,522 B1 * 7/2001 Dickson ..... 446/120

* cited by examiner

*Primary Examiner*—J. J. Swann
*Assistant Examiner*—Andrea Chop
(74) *Attorney, Agent, or Firm*—Phillips, Lytle, Hitchcock, Blaine & Huber LLP

(57) ABSTRACT

An improved jewelry finding (20) has a first member (21) provided with a first opening (24) therethrough, and a second member (22) provided with a second opening (25) therethrough. The two members are fixed to one another such that the axes ($y_1$—$y_1$, $y_2$—$y_2$) of the first and second openings are oriented at an acute included angle (θ) with respect to one another when seen along a line joining the center of these members. The finding may include a third member (e.g., 33 or 43). The center of the third member may be on this imaginary line, or the center of the three members may be arranged at the apices of an imaginary triangle. A multi-strand necklace formed by passing stylets through the member openings will have a generally twisted or intertwined appearance.

14 Claims, 6 Drawing Sheets

JEWELRY FINDING FOR PRODUCING A NECKLACE HAVING A TWISTED APPEARANCE

TECHNICAL FIELD

The present invention relates generally to jewelry findings, and, more particularly, to an improved multi-strand jewelry finding from which a necklace having a twisted or intertwined appearance may be formed.

BACKGROUND ART

Necklaces have been used since time immemorial to adorn the human body. Such necklaces come in a myriad of different forms. The particular shape or appearance of the necklace, and components thereof, is largely a matter of aesthetics and cosmetics. Some necklaces are inherently simple, such as a strand of pearls. This consists of a stylet that is passed through diametrical holes provided through a plurality of substantially-spherical pearls.

The adjacent elements of a necklace may be the same, or may be different from one another. Other necklaces have a somewhat serpentine look in appearance.

It would be desirable to provide other shapes and appearances to necklaces as well.

DISCLOSURE OF THE INVENTION

The present invention broadly provides an improved jewelry finding from which a necklace having a twisted or intertwined shape or appearance may be readily formed.

With parenthetical reference to the corresponding parts, portions or surfaces of the disclosed embodiment, merely for purposes of illustration and not by way of limitation, the improved finding (20) broadly includes a first member (21) having a first opening (24) therethrough, a second member (22) having a second opening (25) therethrough, and wherein the two members are fixed to one another such that the axes of the first and second openings ($y_1$—$y_1$ and $y_2$—$y_2$, respectively) are oriented at an acute included angle ($\theta$) with respect to one another, when seen along an imaginary line (x—x) joining the centers of the members.

The magnitude of the angle depends on the number of members that are joined together. If the members are spherical balls and only two are provided, a pleasing appearance has been obtained if the acute included angle ($\theta$) is within the range of about 60–80°, and is preferably about 70°. As noted above, either or both of the members may have substantially-spherical outer surfaces. Each member may have an outer surface substantially configured as a surface of revolution generated about a point on the line. The members may be substantially hollow, and formed of a precious metal, such as gold.

The finding may further include a third member (e.g., 33 in FIG. 3, or 43 in FIG. 5) having a third opening (e.g., 36 or 46, respectively) therethrough, and wherein the third member is fixed to at least one of the first and second members such that the axis of the third member is oriented at an acute included angle ($\theta$) with respect to the axis of the opening through each member to which it is joined, when seen along an imaginary line joining the members.

The line may be straight-line that passes through the centers of the first, second and third members. Alternatively, the centers of first, second and third members may be arranged at the apices of an imaginary triangle. This triangle may be equilateral if all three members are of substantially the same size, or may be isosceles if only two of the members are the same size.

Accordingly, the general object of the invention is to provide an improved multi-strand jewelry finding.

Another object is to provide an improved jewelry finding from which a necklace having a twisted or intertwined appearance may be formed.

These and other objects and advantages will become apparent from the foregoing and ongoing written specification, the drawings, and the appended claims.

DESCRIPTION OF THE PREFERRED EMBODIMENTS

Figure 2:
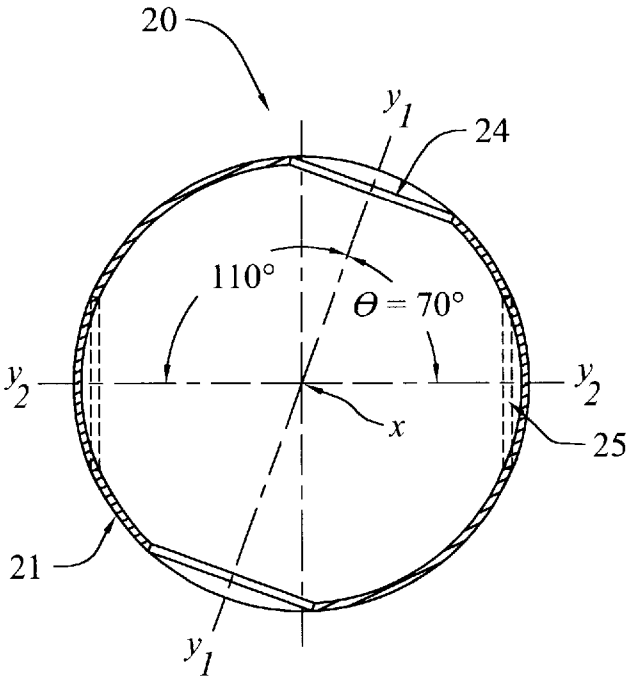
FIG. 2 is a vertical sectional view thereof, taken generally on line 2—2 of FIG. 1.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 1:
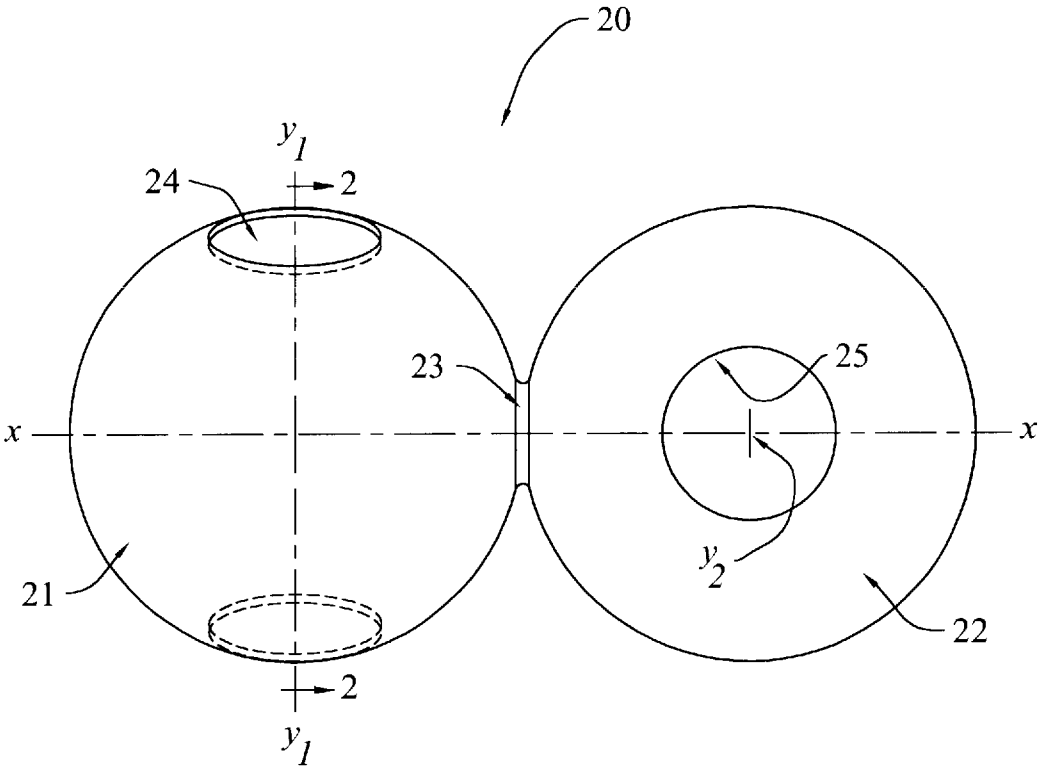
FIG. 1 is a side elevation of a first form of the improved finding, this form having two hollow spherical balls, with the axes of the diametrical openings therethrough being arranged at an acute included angle of about 70°.
Figure 7:
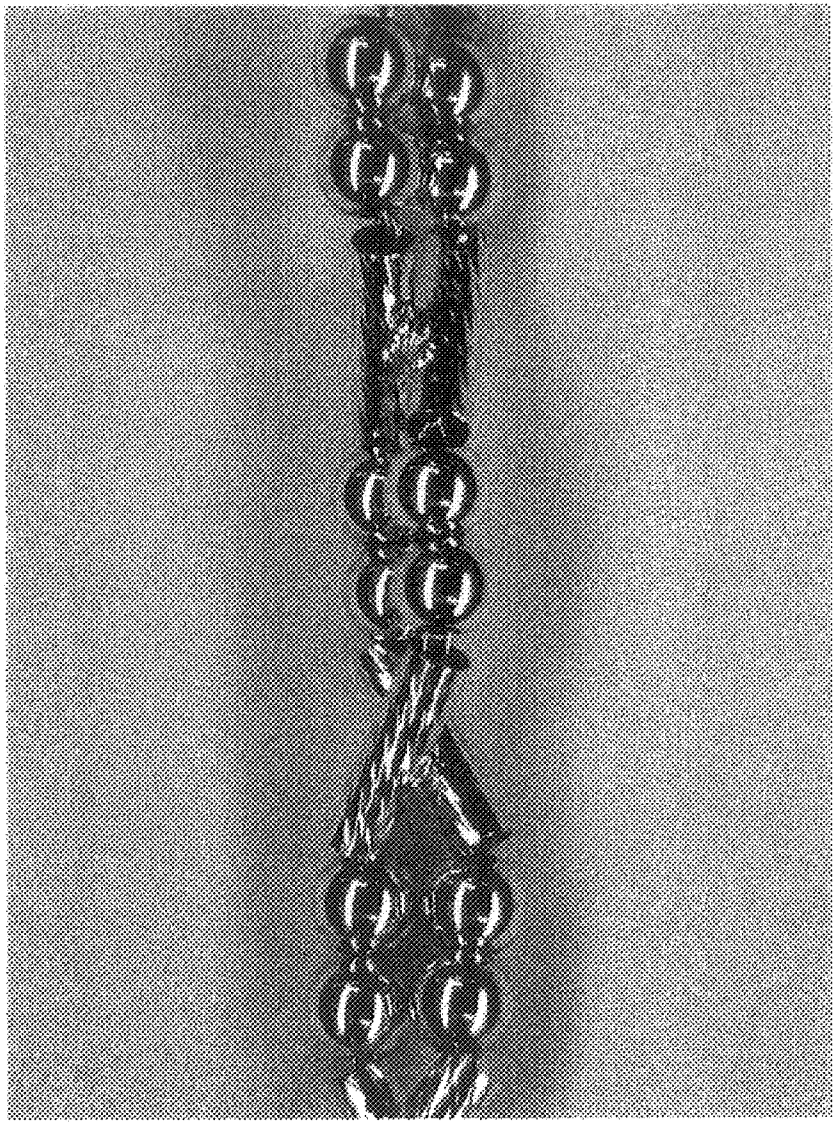
FIG. 7 is a side elevation of a multi-strand necklace formed of the finding shown in FIGS. 1 and 2.
Figure 8:
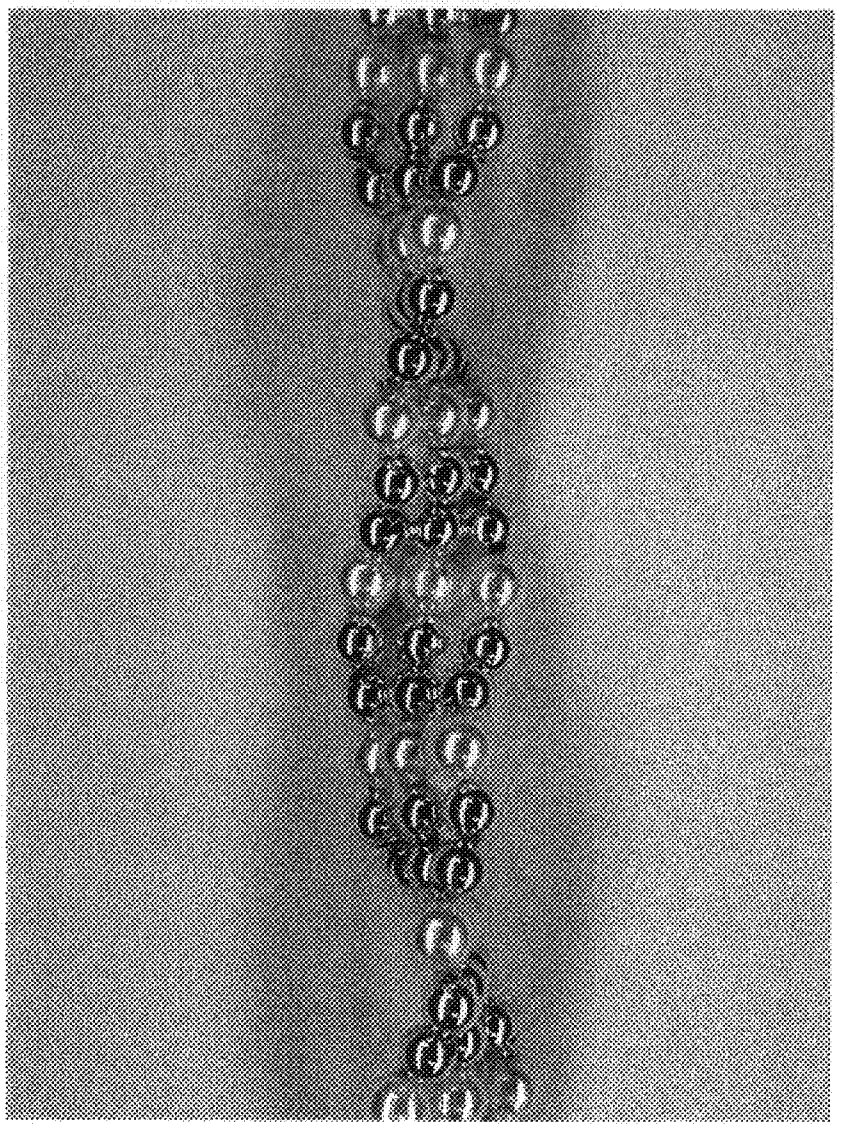
FIG. 8 is a side elevation of a multi-strand necklace formed of the finding shown in FIGS. 3–4.
Figure 9:
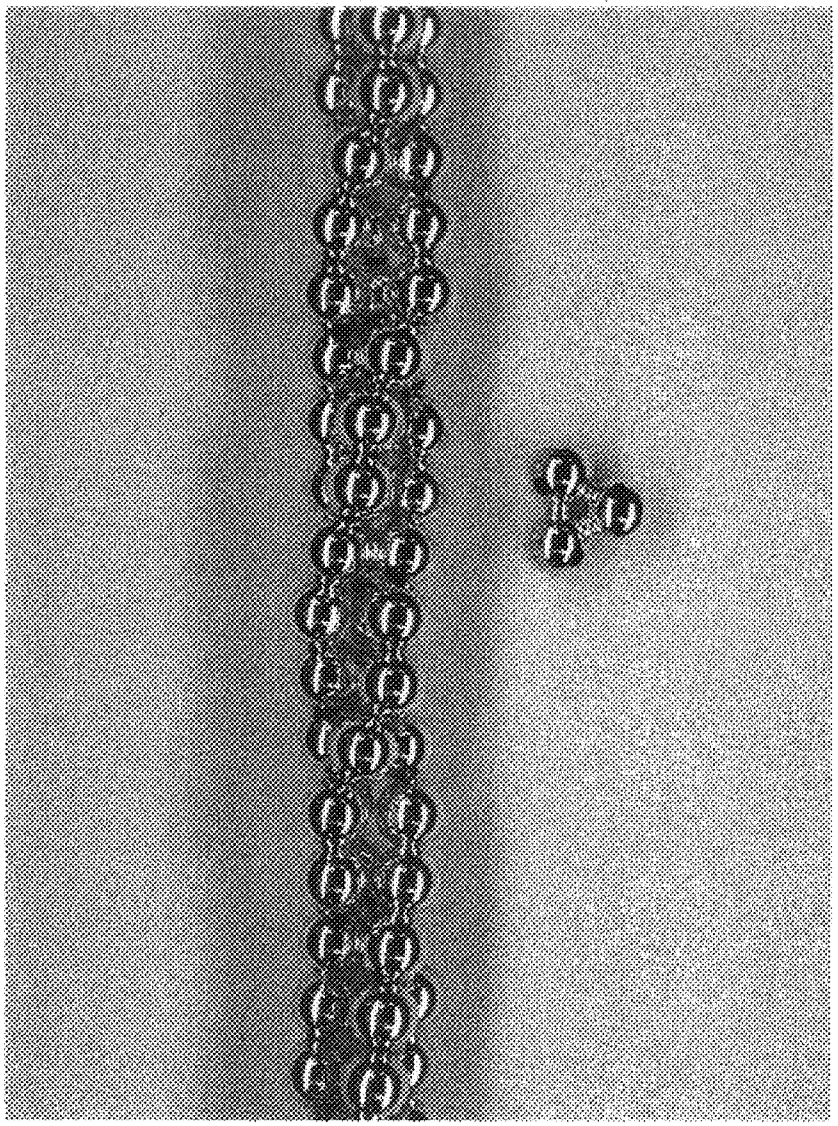
FIG. 9 is a side elevation of a multi-strand necklace formed of the finding shown in FIGS. 5–6.

Referring now to the drawings, the present invention discloses three presently-preferred forms of the improved finding. The first form is depicted in FIGS. 1–2, the second in FIGS. 3–4, and the third in FIGS. 5–6. Necklaces formed of these three findings are depicted in FIGS. 7–9, respectively. These three forms are simply illustrative of three different, but presently preferred forms, of implementing the present invention. However, the appended claims should not be construed as being limited to any of these forms. Indeed, the appended claims may cover other forms as well.

Referring now to FIGS. 1 and 2, the first preferred form of the improved finding is generally indicated at 20. This form is shown as having two substantially-spherical hollow balls. The left ball 21 is joined to the right ball 22, as by a braze 23 therebetween. The first and second balls are thus fixedly connected to one another. Each of these balls has a diametrical through-opening. As best shown in FIG. 2, the first opening 24 through leftward ball 21 has an axis $y_1$—$y_1$. The second opening 25 through rightward ball 22 has an axis $y_2$—$y_2$. Axes $y_1$—$y_1$ and $Y_2$—$Y_2$ are oriented at an acute included angle (θ) of about 70°, when looking along a straight-line (x—x) joining the centers of the two balls. In the form shown, these two balls are formed of a precious metal, such as a suitable gold, and may have an outer diameter on the order of 3.0 millimeters and a radial thickness of about 0.00198 inches. While the acute included angle (θ) between the two axes is shown as being 70° in this first form (see FIG. 2), this angle may readily be varied. It is presently preferred that such angle be within the range of 60–80°, although this range should not be construed as limitative of the scope of the appended claims unless an express limitation to that effect appears therein.

Figure 3:
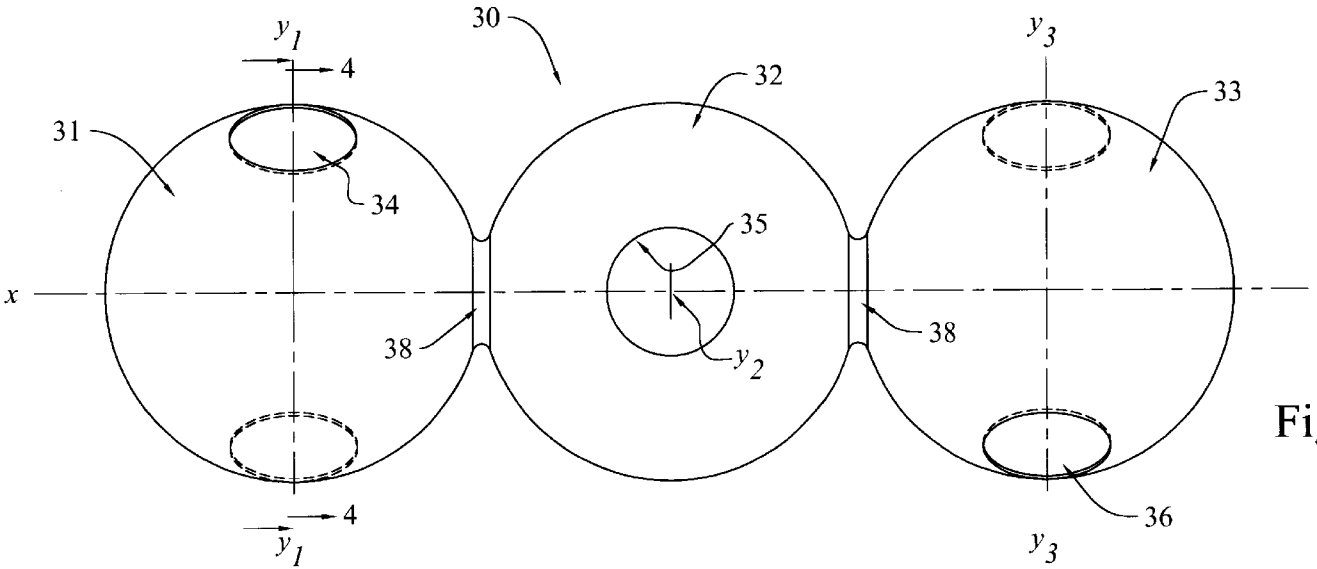
FIG. 3 is a side elevation of a second form of the improved finding, this form having three hollow spherical balls connected along a straight-line, with the axes of the diametrical openings therethrough being arranged at an acute included angle of approximately 70° with respect to one another when seen along the axis of the straight-line connecting their centers.
Figure 4:
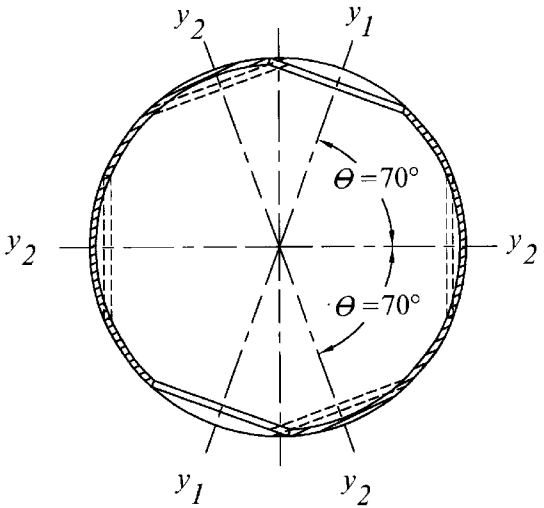
FIG. 4 is a vertical sectional view thereof, taken generally on line 4—4 of FIG. 3.

Referring now to FIGS. 3 and 4, a second preferred form of the improved finding is generally indicated at 30. This form is shown as including three hollow substantially-spherical balls, 31, 32 and 33, respectively, having their centers arranged along a straight-line having an axis x—x. The three balls are provided with diametrical through-openings 34, 35 and 36, respectively, having axes $y_1$—$y_1$, $Y_2$—$Y_2$ and $y_3$—$y_3$, respectively. As shown in FIG. 4, the three balls are arranged such that the axis $y_1$—$y_1$ of the leftwardmost ball is arranged at an acute included angle of about 70° with respect to the axis $Y_2$—$Y_2$ of the middle ball, and the axis of the third opening $y_3$—$y_3$ is also arranged at an acute included angle of about 70° with respect to the axis of the middle ball. However, the orientation of the holes is reversed between the first and third balls. In other words, left ball axis $y_1$—$y_1$ is displaced from middle ball axis $Y_2$—$Y_2$ in a counterclockwise direction by acute included angle θ, while right ball axis $y_3$—$y_3$ is displaced from middle ball axis $y_2$—$y_2$ in a clockwise direction by angle θ. Adjacent balls are joined by brazes, severally indicated at 38.

Figures 5, 6:
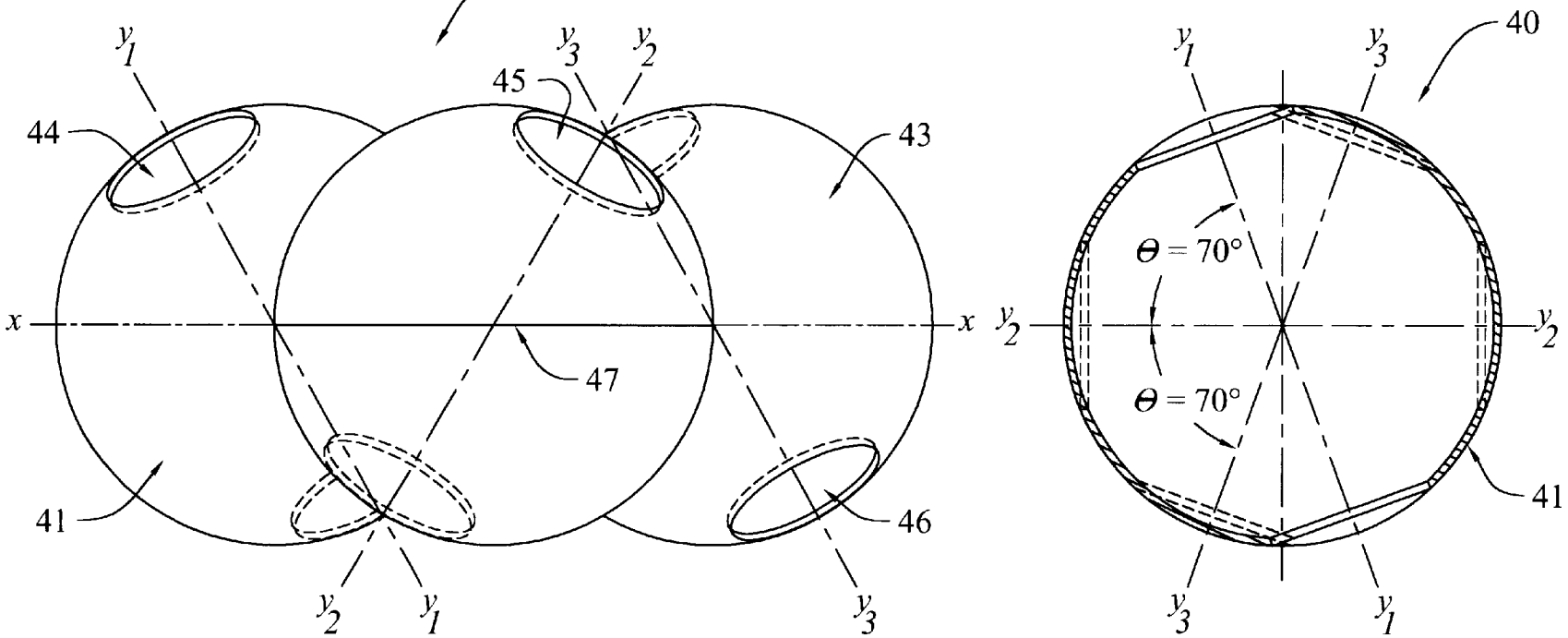
FIG. 5 is a side elevation of a third form of the improved finding, this view showing the centers of each of three hollow spherical balls being arranged at the apices of an imaginary triangle, with the axes of the opening through the adjacent balls being arranged at an acute included angle of about 70° with respect to one another.
FIG. 6 is a fragmentary vertical sectional view thereof, looking along a line connecting the centers of balls 41, 43, with ball 42 removed.

The third preferred form of the improved finding is generally indicated at 40 in FIGS. 5 and 6. In this form, the finding again includes three hollow substantially-spherical balls 41, 42 and 43 having axes $y_1$—$y_1$, $y_2$—$y_2$ and $y_3$—$y_3$, respectively. The balls are joined by intermediate brazes (not shown in FIG. 5), as shown in the other forms. Each ball has a diametrical through-opening, 44, 45 and 46, respectively, and the balls are oriented such that the opening axes of any two adjacent contiguous balls are arranged at an acute included angle (θ) of about 70° with respect to one another, as best shown in FIG. 6. Axes $y_1$—$y_1$ and $y_3$—$y_3$ are shown as being inclined at an angle of about 70° with respect to axis $y_2$—$y_2$, although the relative orientation between these axes is reversed. The centers of the three balls are therefore arranged at the apices of an imaginary triangle, indicated at 47.

The invention thus includes a plurality of elements or members that are fixed to one another. Each member has a through-opening, and the members are fixed to one another such that their respective through-openings are oriented at a particular relationship to one another. Thus, a necklace may be formed by simply threading a stylet through the openings of adjacent findings, and such that a necklace formed thereby will have a generally twisted or interwoven look or appearance.

A necklace formed of the finding embodiment shown in FIGS. 1 and 2, with interruption by a cylinder between pairs of adjacent findings, is shown in FIG. 7. This necklace is seen as having a twisted appearance.

Another necklace formed by adjacent strands of the second form shown in FIGS. 3 and 4 is depicted in FIG. 8. Here, pairs of adjacent metal findings are separated by other findings made of a dissimilar material. Here again, the overall necklace is seen as having a generally twisted configuration.

FIG. 9 depicts a necklace formed by assembling adjacent findings of the third form shown in FIGS. 5–6. Here, the necklace has the outward appearance of three interwoven or helically-wound individual strands. Thus, all three forms of the necklace have a generally twisted outer shape or configuration.

MODIFICATIONS

The present invention contemplates that many changes and modifications may be made. For example, the finding or any individual portion thereof, may be formed of a suitable precious metal, such as gold or gold alloy. Alternatively, such finding may be formed of other metals, and still other materials, such as pearl. While it is presently preferred to use spherical balls, the shape of the individual members may differ. For example, the members might have a polygonal outer configuration, or some type of an elliptical configuration as well. Indeed, the outer surface of these members may generally be, or simulate, a surface of revolution generated about a point. The members themselves may be solid or hollow. In the first form, the acute included angle is preferably between 60–80°, with 70° creating a particularly pleasing appearance. In the second and third forms, the acute included angle is preferably 70°. Necklaces of different shapes and forms may be formed by joining adjacent findings, or by interpreting individual or clusters of findings by other or dissimilar elements, all depending upon the skill of the particular designer.

Therefore, while three preferred forms of the improved finding have been shown and described, and several modifications thereof discussed, persons skilled in this art will readily appreciate that various additional changes and modifications may be made without departing from the spirit of the invention, as defined and differentiated by the following claims.

What is claimed is:

1. A jewelry finding, comprising:

a first member having a first opening therethrough;

a second member having a second opening therethrough;

said members being physically fused to one another such that the axes of said first and second openings are oriented at an acute included angle with respect to one another when seen along a line joining the centers of said members.

2. A jewelry finding as set forth in claim 1 wherein said included angle is within the range of about 60–80°.

3. A jewelry finding as set forth in claim 1 wherein said first member has a substantially-spherical outer surface.

4. A jewelry finding as set forth in claim 3 wherein said first opening passes diametrically through said first member.

5. A jewelry finding as set forth in claim 1 wherein said second member has a substantially-spherical outer surface.

6. A jewelry finding as set forth in claim 5 wherein said second opening passes diametrically through said second member.

7. A jewelry finding as set forth in claim 1 wherein at least one of said members has an outer surface substantially configured as a surface of revolution generated about a point on said line.

8. A jewelry finding as set forth in claim 7 wherein said one member is substantially hollow.

9. A jewelry finding as set forth in claim 1 wherein at least one of said members is formed of a precious metal.

10. A jewelry finding as set forth in claim 1 and further comprising a third member having a third opening therethrough, and wherein said third member is fixed to at least one of said first and second members such that the axes of the connected member openings are oriented at an acute included angle with respect to one another when seen along a line joining the center of said third member with the center of the member to which it is fixed.

11. A jewelry finding as set forth in claim 10 wherein said line is a straight-line that passes through the centers of said first, second and third members.

12. A jewelry finding as set forth in claim 10 wherein the centers of said first, second and third members are arranged at the apices of an imaginary triangle.

13. A jewelry finding as set forth in claim 10 wherein said members have substantially the same shape and are of substantially the same size.

14. A jewelry finding as set forth in claim 10 wherein said angle is about 70°.

* * * * *